US009147304B2

(12) United States Patent
Gemberling, Jr. et al.

(10) Patent No.: US 9,147,304 B2
(45) Date of Patent: Sep. 29, 2015

(54) REVERSIBLE MULTI-POSITION GEARMOTOR AND STORAGE TRAY FOR VENDING MACHINES

(76) Inventors: George Gemberling, Jr., Streamwood, IL (US); George Gemberling, Sr., Sleepy Hollow, IL (US); Vasiliy Maksimov, Huntley, IL (US); Brian L. Steeley, Charles Town, WV (US); David Campbell, Winchester, VA (US)

( * ) Notice: Subject to any disclaimer, the term of this patent is extended or adjusted under 35 U.S.C. 154(b) by 793 days.

(21) Appl. No.: 13/064,527

(22) Filed: Mar. 30, 2011

(65) Prior Publication Data

US 2012/0247246 A1 Oct. 4, 2012

(51) Int. Cl.
*G07F 11/42* (2006.01)
*G07F 11/36* (2006.01)

(52) U.S. Cl.
CPC ..... *G07F 11/42* (2013.01); *G07F 11/36* (2013.01); *Y10T 74/19642* (2015.01)

(58) Field of Classification Search
USPC ..... 221/2, 4, 5, 69–71, 75, 92, 123, 124, 221/131, 133, 208, 258, 277
See application file for complete search history.

(56) References Cited

U.S. PATENT DOCUMENTS

| | | | | | |
|---|---|---|---|---|---|
| 3,773,217 | A * | 11/1973 | Schlaf | 221/75 |
| 3,952,915 | A * | 4/1976 | Pitel et al. | 221/75 |
| 4,061,245 | A * | 12/1977 | Lotspeich | 221/75 |
| 4,124,142 | A * | 11/1978 | Albright | 221/75 |
| 4,354,613 | A * | 10/1982 | Desai et al. | 377/1 |
| 4,600,119 | A * | 7/1986 | Olson | 221/75 |
| 4,844,294 | A * | 7/1989 | Albright | 221/75 |
| 5,159,957 | A * | 11/1992 | Hehl | 137/883 |
| 5,172,605 | A * | 12/1992 | Schwartz | 74/421 A |
| 5,186,355 | A * | 2/1993 | VonDelinde et al. | 221/75 |
| 5,256,921 | A * | 10/1993 | Pruis et al. | 310/68 B |
| 5,303,844 | A * | 4/1994 | Muehlberger | 221/1 |
| 5,341,954 | A * | 8/1994 | Smith | 221/85 |
| 5,446,326 | A * | 8/1995 | Scheider | 310/83 |
| 5,463,914 | A * | 11/1995 | Tyan | 74/661 |
| 5,649,641 | A * | 7/1997 | Campoli | 221/197 |
| 5,737,968 | A * | 4/1998 | Hardey et al. | 74/421 A |
| 6,145,699 | A * | 11/2000 | Pollock | 221/75 |
| 6,202,888 | B1 * | 3/2001 | Pollock et al. | 221/1 |
| 6,540,102 | B2 * | 4/2003 | Gates et al. | 221/75 |
| D620,437 | S | 7/2010 | Gemberling, Jr. et al. | |
| 8,052,010 | B2 * | 11/2011 | Borra | 221/124 |
| 8,413,843 | B2 * | 4/2013 | Vardaro | 221/279 |
| 8,550,293 | B2 * | 10/2013 | Garson et al. | 221/75 |
| 2005/0087544 | A1 * | 4/2005 | Skavnak | 221/75 |
| 2007/0012716 | A1 * | 1/2007 | Skavnak | 221/75 |
| 2010/0280655 | A1 * | 11/2010 | Wilson et al. | 700/231 |
| 2011/0015781 | A1 * | 1/2011 | Vardaro | 700/231 |

* cited by examiner

*Primary Examiner* — Gene Crawford
*Assistant Examiner* — Kelvin L Randall, Jr.
(74) *Attorney, Agent, or Firm* — Davidson Berquist Jackson & Gowdey LLP

(57) ABSTRACT

A vending machine gearmotor that can be mounted in a variety of orientations and positions to better operate a variety of different size helix product drives and which permits a single type or design for a gearmotor to be used throughout a vending machine to drive single or dual-spiral selections. In this regard, the gearmotor can be used to rotate helix drives in either clockwise or counter clockwise directions with minimal effort required to change the direction of rotation. Thus, the gearmotors can be used in paired arrangements with two adjacent gearmotors being mounted in reversed directions so that one drives its helix in counter clockwise direction and the adjacent helix is driven in a clockwise direction with a product to be vended being carried by both adjacent helixes.

16 Claims, 11 Drawing Sheets

REVERSIBLE MULTI-POSITION GEARMOTOR AND STORAGE TRAY FOR VENDING MACHINES

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO CO-PENDING APPLICATIONS

The present invention is related to the U.S. Pat. No. D620,437 which issued on Jul. 27, 2010.

FIELD OF THE DISCLOSURE

This disclosure relates to a gearmotor for use in vending machines and in particular to a gearmotor design that permits multiple uses of the gearmotor in a variety of vending machine configurations.

DESCRIPTION OF PRESENTLY PREFERRED EXAMPLES OF THE INVENTION

Brief Description of Figures

The invention is better understood by reading the following detailed description with reference to the accompanying drawings in which.

DETAILED DESCRIPTION OF THE PREFERRED EXEMPLARY EMBODIMENT

A. Overview

Figure 1:
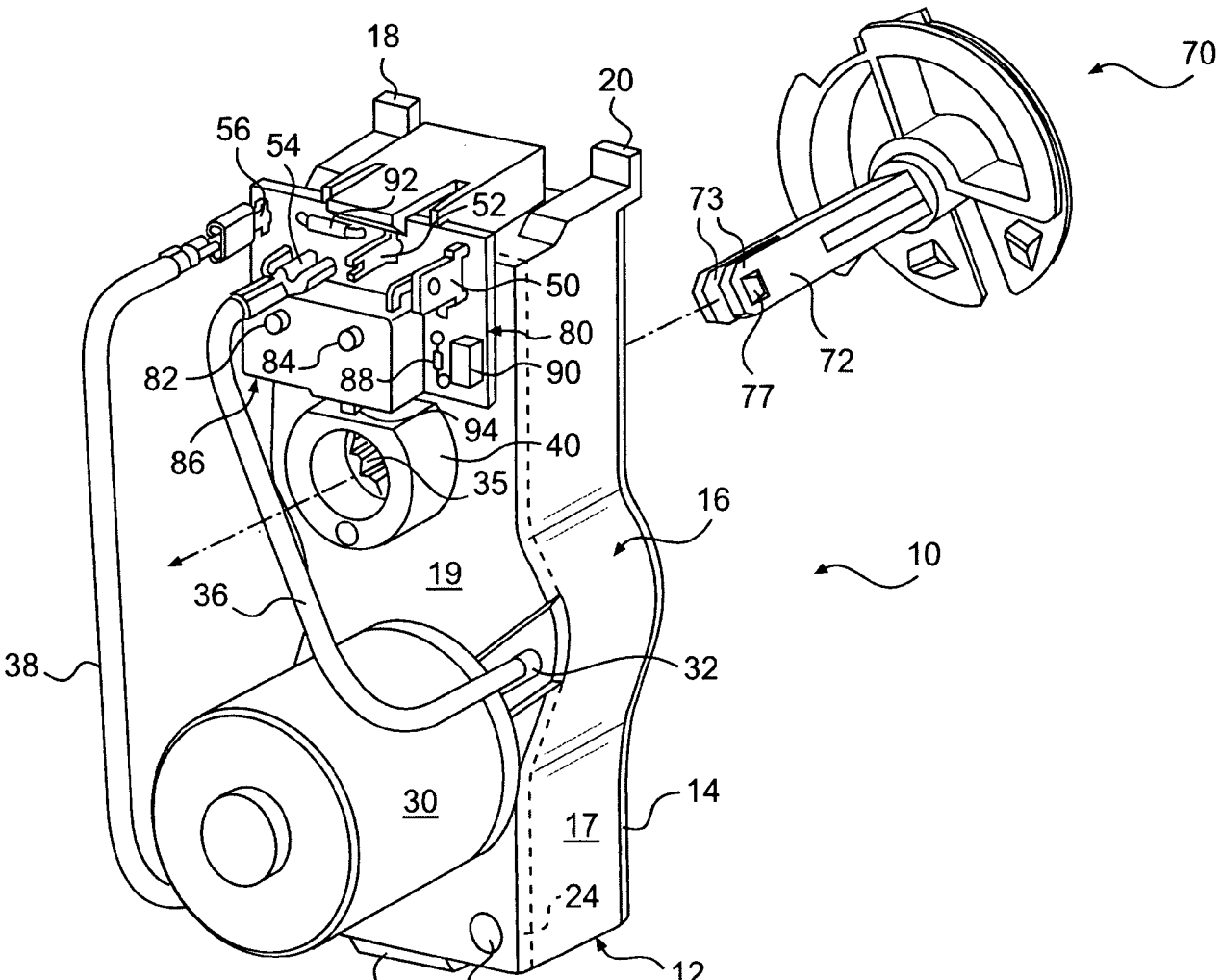
FIG. 1 is a front perspective view of the gearmotor and showing a helix drive in an exploded form.

To gain a better understanding of the invention, a preferred embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The preferred embodiment now described will be with respect to a vending machine capable of vending a variety of product types. The scale of the embodiment, therefore, is to be understood with respect to this type of article. It is to be understood as well, however, that the invention is applicable to other articles and its scale can vary accordingly.

C. Structure

The gearmotor, sometimes described as an "S-Motor," has been designed with a shaped outer housing that permits not only a variety of positional uses, spacings and mountings, but this gearmotor can also be nested one against another along the rear wall of a vending shelf. Gearmotor 10 can be used to drive single or adjacent helixes in the same or reverse directions of rotation and thereby can accommodate not only the vending of large, wide or bulky items, at one end of the spectrum, that can be moved along the tray by two counter rotating helixes, but also items at the other end of that product size spectrum which would include narrow product storage needing small or vary small diameter helixes. Room in vending machines is frequently at a premium and sometimes when vending small products, for example gum, a head set, a battery, a pencil, the available storage space between rows of products is small and the space across the vending shelf can become crowded. Consequently, it is helpful at times to be able to use small helixes and the drives thereof. It is also desirable to be able to drive helixes in a way that permits a quick and easy way to change the rotational direction of helixes as product configurations change.

Figure 2:
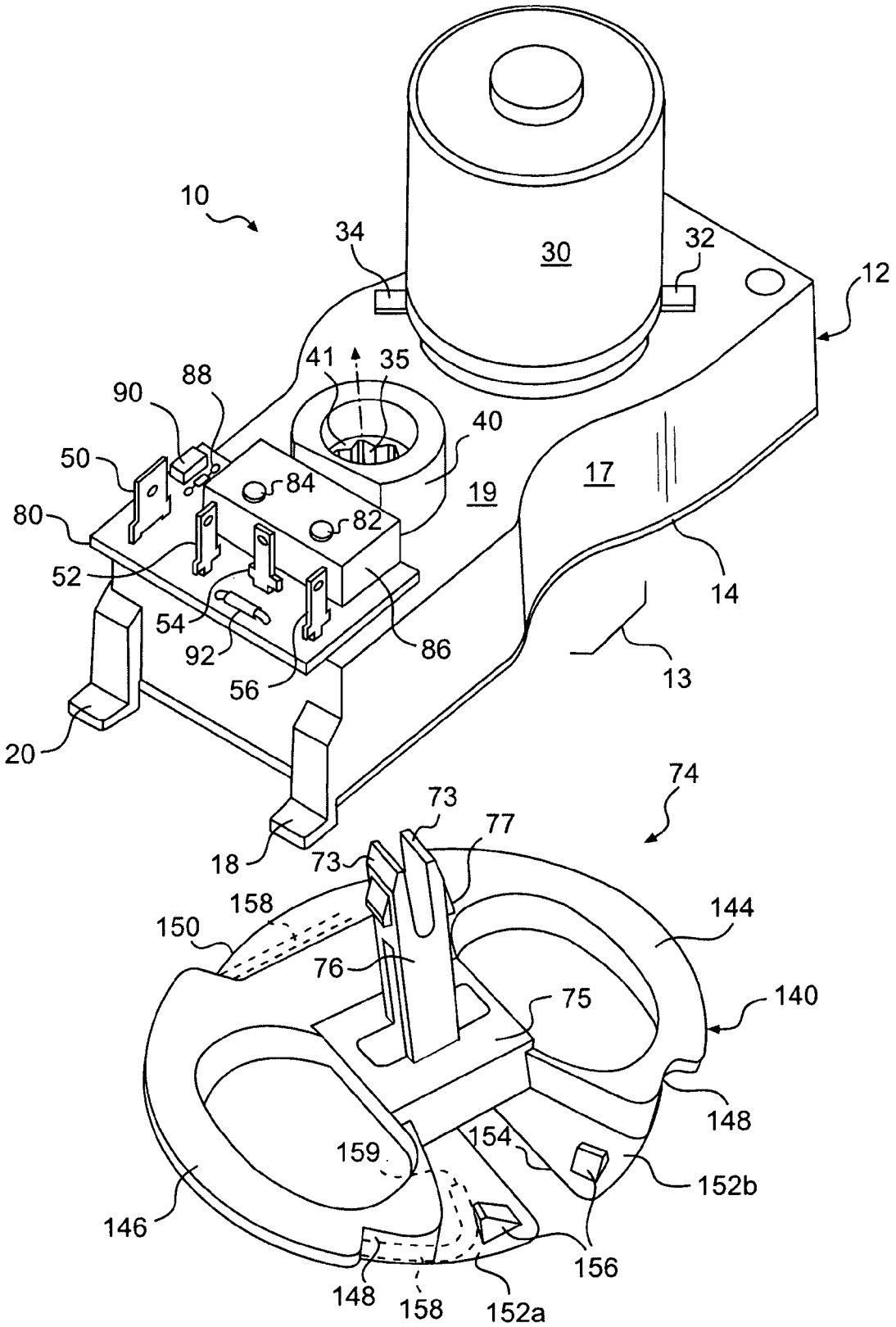
FIG. 2 is another front perspective view of the gearmotor with a different helix drive in an exploded form

FIGS. 1-4 show the gearmotor in several views with FIGS. 1 and 2 including an exemplary drive member for a helix within or on which product will be stored and moved to be dispensed when rotated.

FIG. 1 shows the gearmotor 10 as including an outer housing 12 comprised of a rear cover 14 and a front housing 16. Cover 14 can be attached, for example, to front housing 16 by being either snap fit or welded in place, for example, by heat stakes, one of which is shown at 15. Front housing 16 can itself be comprised of side walls 17 and a front wall 19. However, it should be understood that the front housing 16 could be formed from a separate front wall, as shown in phantom in FIG. 1 at 24, together with a molded side section, or as a one piece structure as shown in full line. The outer housing 12 can be formed from a variety of materials including plastics, thermo-plastics, poly-carbonates, filled or reinforced plastics, nylon, metal, combinations of metal and plastic or of other formable or shapeable materials, including composite materials.

Figure 3:
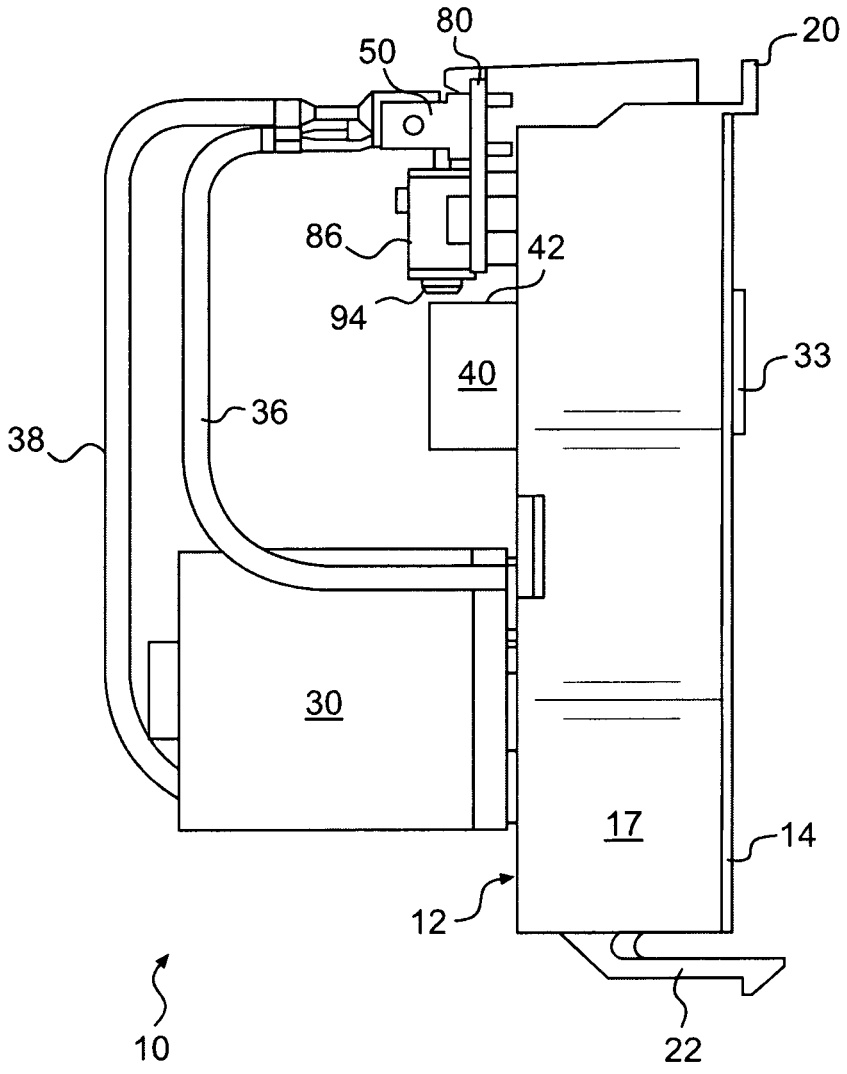
FIG. 3 shows a side view of the gearmotor.

Outer housing 12 also includes a pair of spaced apart mounting tabs 18 and 20 on one end, as shown in FIGS. 1-3, and a spring type mounting clip 22 at an opposite end. However, it should be understood that spring clips 22 could be used at both ends and that other modes of attachment might be used as well, it being important to be able to removably mount gearmotors 10 in place on product support trays, like the one shown in FIGS. 6A, 6B and 7. It is also a feature of gearmotor 10 that the orientation is changeable by being moved vertically between several positions, horizontally across the rear of the tray, as well as possibly being flipped over for certain uses. Thus, gearmotors 10 can be spaced widely apart for large diameter helixes, they can be located directly next to one another for the closest of spacing and for operating the smallest of helixes as is shown in phantom in FIG. 4 where two gearmotors 10 are nested next to one another.

Housing 12 can be made in various sizes with one exemplary size being about 3.4 inches high, 1.3 inches wide and about 0.8 inches deep. The motor 30 and the drive cylinder 41 can each be located on the housing about one third of the length of the housing from their respective ends, or about 1 inch from respective ends of housing 12.

Figure 4:
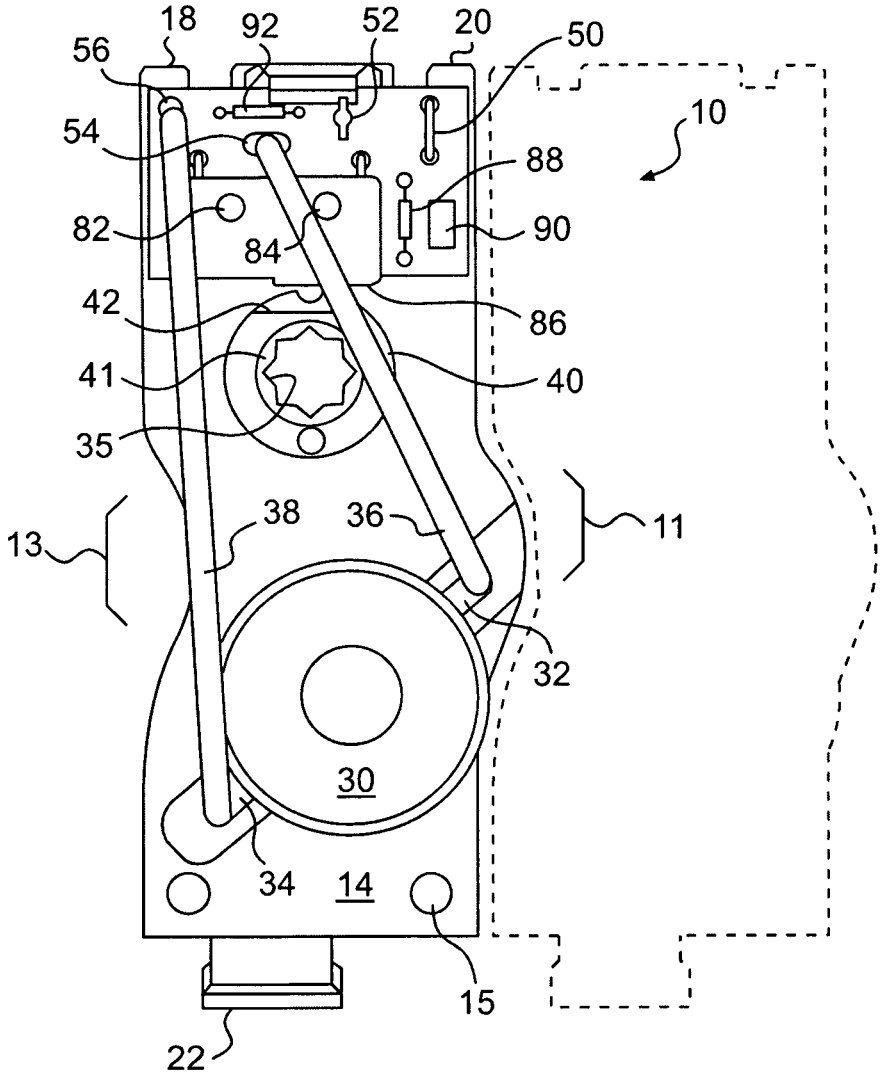
FIG. 4 is a front elevation of the gearmotor and shows a directly nesting gearmotor in phantom.

It should be understood that the shaped exterior design of outer housing 12 includes an outwardly extending bulge 11 on the right side, in the view set forth in FIGS. 1 and 4, and a corresponding recess 13 on the left side as shown in FIGS. 2 and 4.

An electric drive motor 30 designed for direct current (DC) operation is mounted on the front wall 19 adjacent one end and includes electrical leads 32 and 34 extending outwardly there from as best shown in FIG. 2. One exemplary motor is WRS-365SA-10185A, 24V, 10300 RPM, by Yeizhen. A rotating cylindrical member 40 is also rotatably retained on wall 19 and can be formed with or otherwise mated with a drive cylinder 41 having a hollow interior space 35. Drive cylinder 41 preferably extends through the full depth of housing 12 including through the interior portion of outer housing 12 (not shown) so as to extend into and rotate within the rear cover 14 where it rotates within an extended bearing surface formed on the rear cover 14 as shown at 33 in FIG. 3. The hollow interior 35 of drive cylinder 41 is shaped or formed with specifically designed interior walls, for example having an octagonal or square cross section, so that a drive shaft, for example, square shaft 72 of a helix drive member 70 as shown in FIG. 1, can be both slidably and removably received therein. The hollow interior 35 preferably extends the full length of the drive cylinder 41 thereby permitting a shaft 72 to be inserted into the shaped hollow interior 35 from either side of outer housing 12. However, it should be understood that the hollow interior 35 need only extend inwardly from rear cover 14 a short distance, sufficient to securely hold the drive shaft of a helix drive member. The length of such a drive shaft, e.g. 72, or whatever shaft is to be used could then be sized as needed with the length of a shortened hollow interior to allow the remainder of the helix drive member to be fully operational. Helix drive member 70 has a smaller outer diameter compared with helix drive member 74 that, as shown in FIG. 2, has a larger diameter. Both employ the same size drive shaft that will fit into the hollow interior 35 of drive cylinder 41. Each drive shaft, 72 and 76 have similar gear attachment ends comprised of spaced apart fingers 73 and externally positioned snap fit lugs 77 molded thereon to snap past the length of the hollow interior 35 to hold the drive members in place.

Member 40 can be attached to the drive cylinder 41 in a number of ways, including, for example, by having rearwardly extending lugs (not shown) that can snap fit into grooves provided therefore on drive cylinder 41, or alternatively, member 40 can be simply glued into the drive cylinder 41. In addition, member 40 and drive cylinder 41 could be formed as a one piece molded structure from materials like those mentioned previously for the outer housing and held in place within housing 12 once the cover 14 has been secured in place. In each such configuration the shaped hollow interior 35 preferably remains the same.

Figure 7:
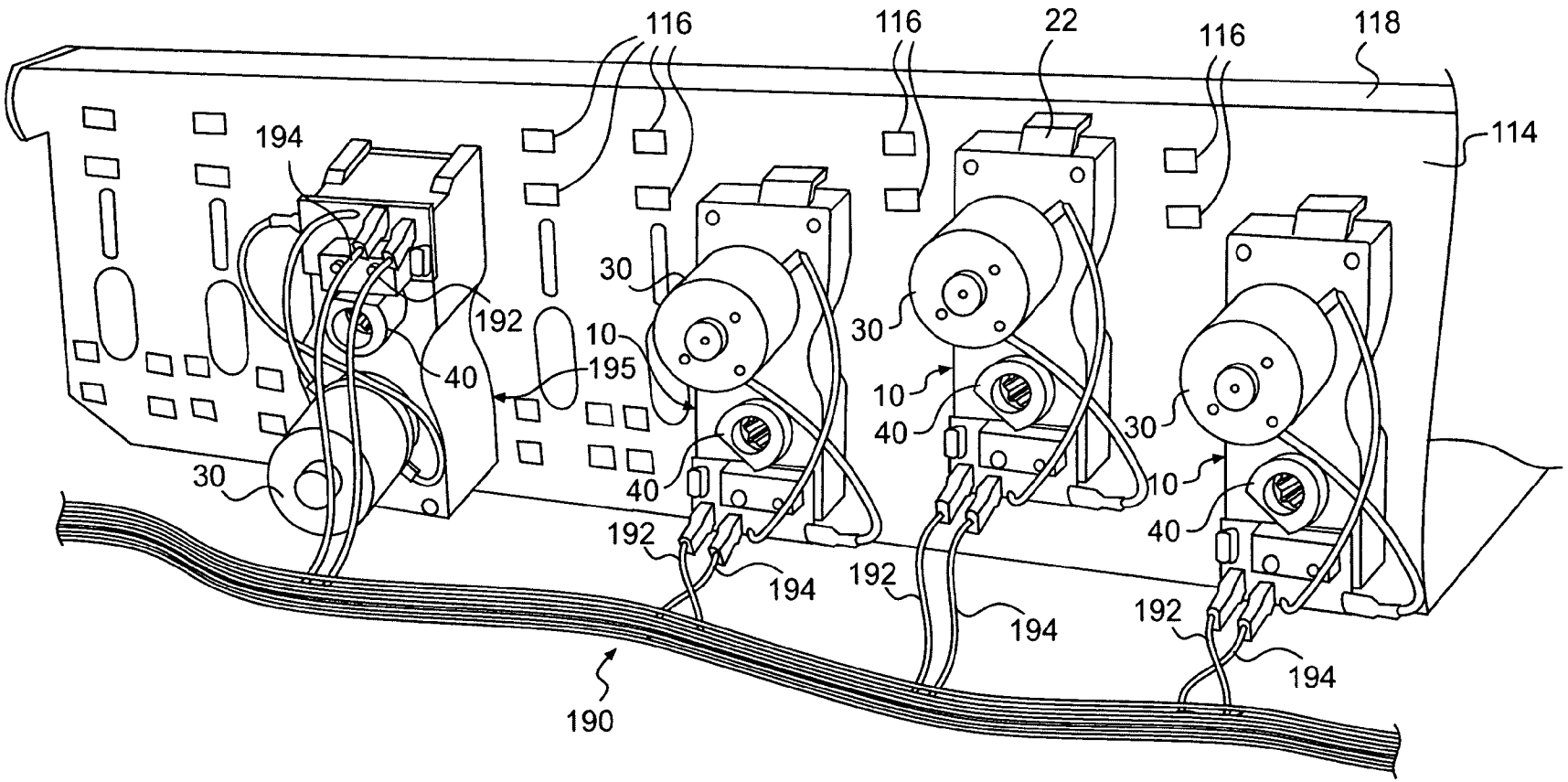
FIG. 7 is a rear elevational view of the vending tray showing gearmotors in various locations.
Figure 8:
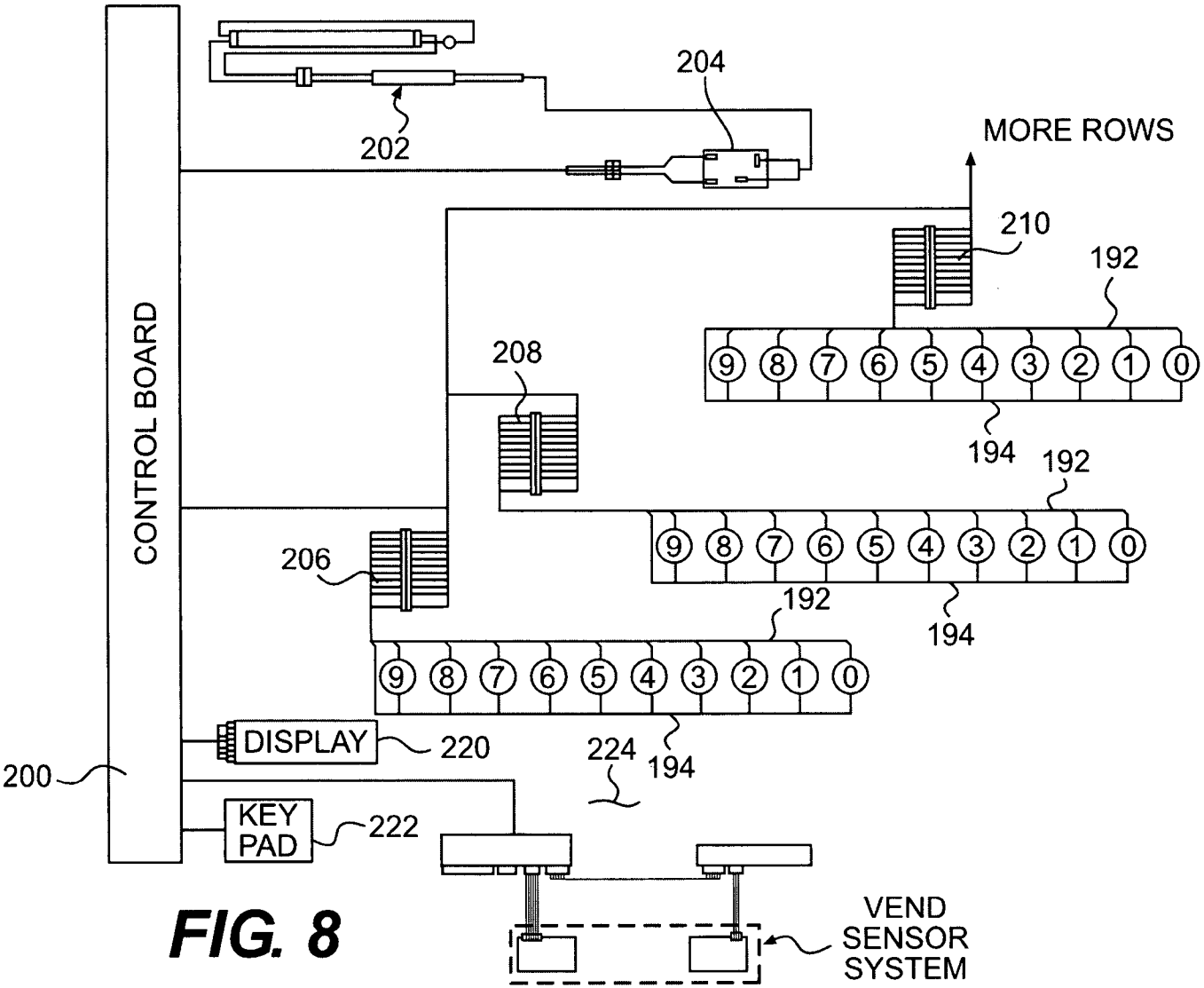
FIG. 8 is an exemplary control circuit for a vending machine motor drive.
Figure 10:
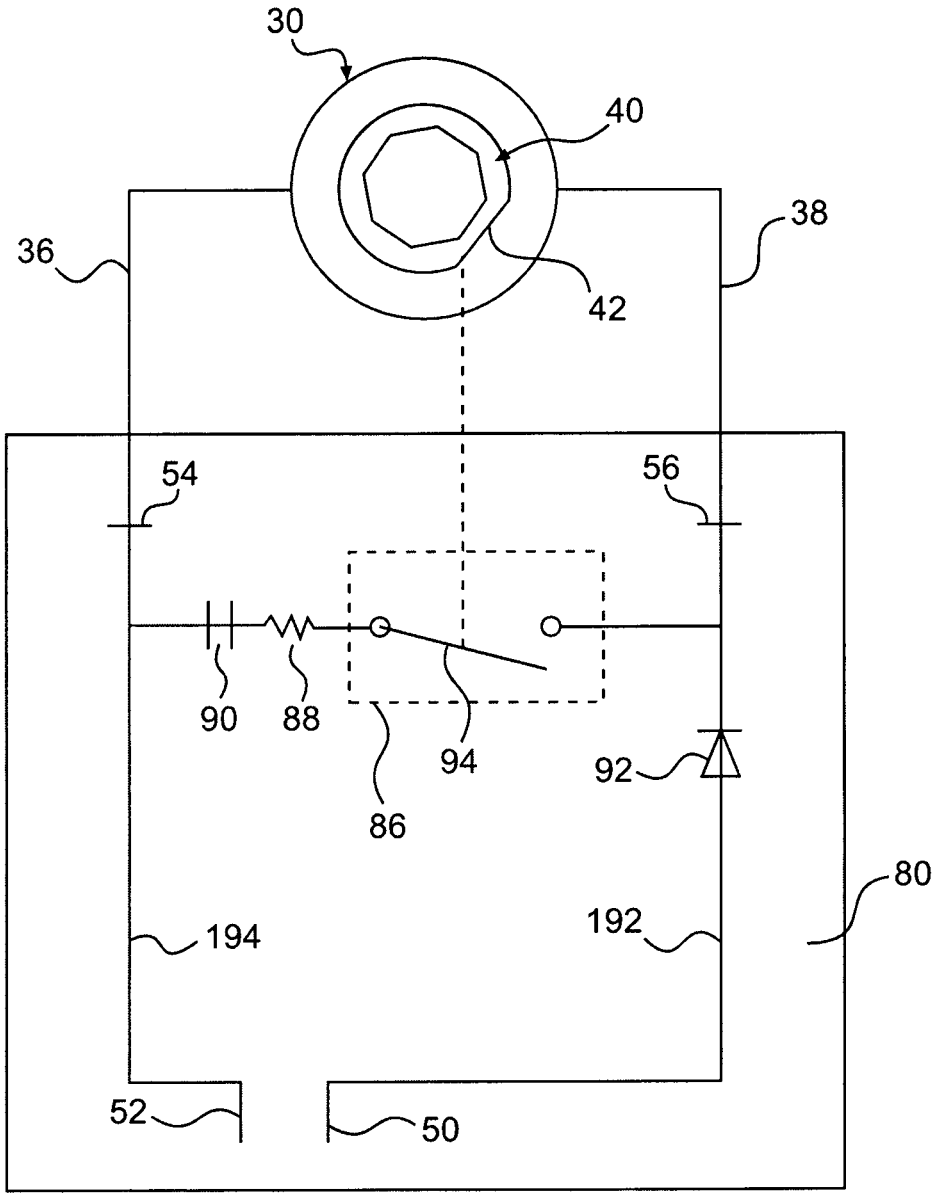
FIG. 10 is an exemplary circuit diagram for the gearmotor.

FIG. 10 schematically represents the small circuit board 80 that is attached at one end of front wall 19 and which is suitably mounted to outer housing 12. A micro switch 86 is attached to board 80 by a locating pin 82 and a screw 84 as shown in FIGS. 1, 2 and 4. FIGS. 1-4 and 10 also show four pin connectors or terminals 50, 52, 54 and 56 as being provided on the circuit board 80. Terminal connectors 50 and 52 are the main power inputs for gearmotor 10 and, as shown in FIGS. 7, 8 and 10, wires 192 and 194, respectively, connected to those terminal connectors 50, 52 to provide incoming power to the gearmotor 10. Terminal connectors 54 and 56 are used for determining the rotation direction for motor 30. Wires 36 and 38 of motor 30 when connected to terminals 54 and 56, respectively, will drive the motor 30 in a clockwise direction. To reverse the rotation direction of gearmotor 10 all that is needed is to change the connection location of wires 36 and 38 to terminals 56 and 54, respectively, which will cause drive motor 30 to rotate in a counter clockwise direction.

Circuit board 80 also has mounted thereon an RC circuit including a resistor 88, a capacitor 90, and a diode 92 which collectively function to serve, along with micro switch 86 as the way of sensing the home rotational position for the gearmotor 10 and specifically of member 40. Resistor 88 can be, for example, a 47 ohm device, capacitor 90 can have a capacitance of about 0.47 mF and diode 92 can be, for example, a 1N4004. Member 40, which is diagrammatically shown in FIG. 10 as being within the structure constituting motor 30 since member 40 is driven by motor 30, includes a flattened portion 42 that serves to operate a button actuator 94 on micro-switch 86 and will be used to help establish a home position for the rotation of the drive cylinder 41 and member 40 and ultimately of a helix being rotated thereby. When motor 30 is actuated the drive cylinder 41 will be rotated by the gear train 100 (shown in FIG. 5) and begin rotation of member 40. The wiring connection shown in FIG. 10 is for clockwise rotation. Initially the flat portion 42 will be facing button 94 and be spaced there from so that the switch 86 is closed. As member 40 starts to rotate the cylindrical exterior of member 40 will come into contact with and depress button 94 and thereby open micro switch 86. As rotation of member 40 continues flat portion 42 will eventually again arrive at a position facing and spaced from button 94 on micro switch 86 at which time button 94 will be released thereby closing micro switch 86 and member 40 will have signaled its return to its home position. The home position detection circuit, which is part of the vending machine control system and not described in further detail here, is designed to place a square wave rider of approximately 60 KHz on the DC power going to motor 30 and with switch 86 open that rider will not be sensed by the control circuits. When the flat portion 42 again appears and releases button 94 switch 86 will again close and that closing of micro switch 86 will permit this 60 KHz square wave rider to flow back to and be sensed by the control circuit on control board 200 which, in turn, will then turn off motor 30.

Figure 5:
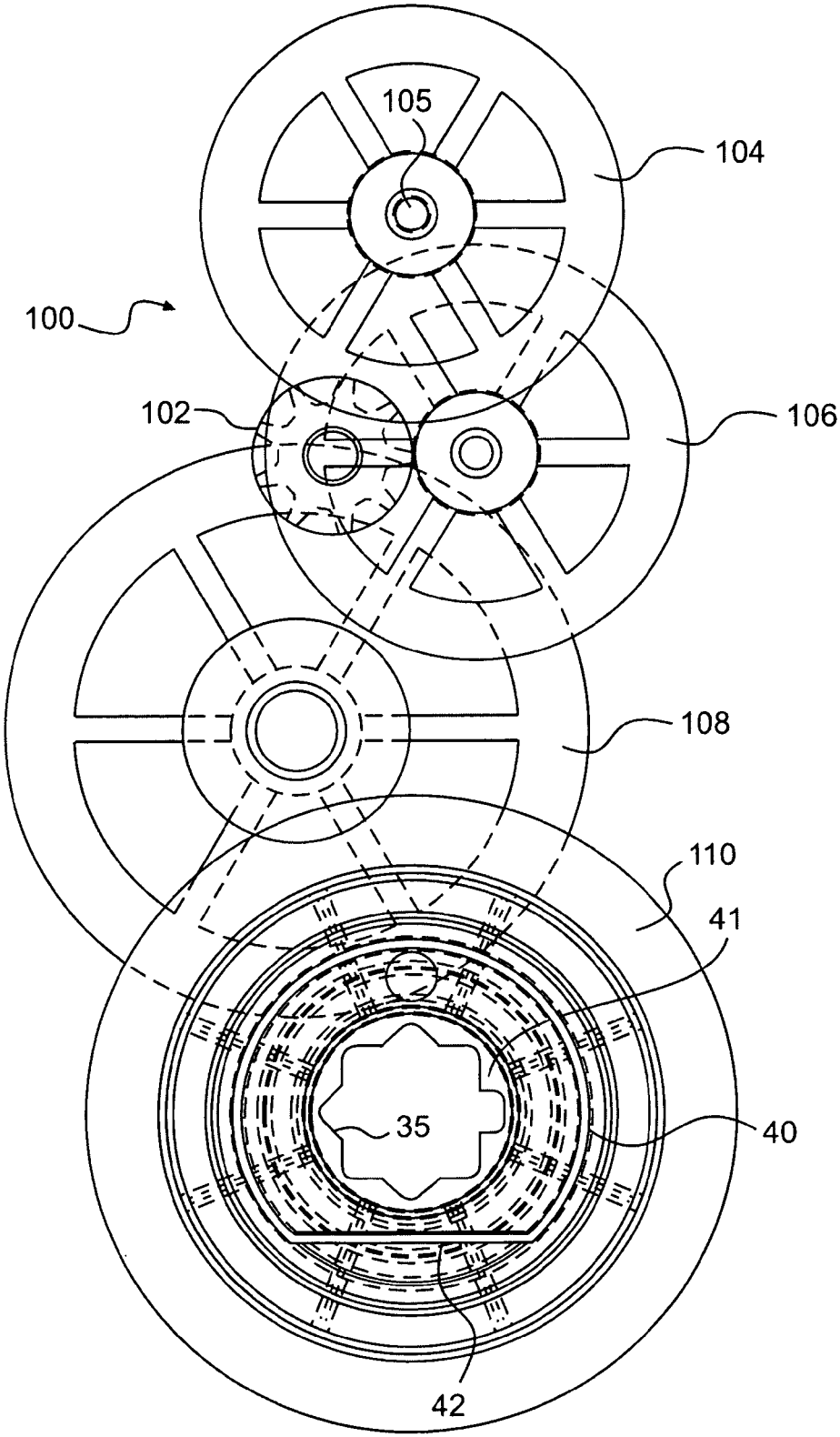
FIG. 5 is a front elevation of the interior gear train.

FIG. 5 shows a gear train 100 comprised of five gears 102, 104, 106, 108 and 110, respectively. It should be understood that the gear train as represented by FIG. 5 is but one exemplary arrangement and that other gears and set ups can be used as well. Here, a drive shaft (not shown) of motor 30 directly drives gear 102 that in turn engages and drives gear 104. The outer portion of gear 104 engages and drives gear 106 that in turn engages and drives gear 108. Gear 108 includes a geared column that extends outwardly form the main portion of gear 108 so as to contact and engage the outer periphery of gear 110 that is formed on or mated with drive cylinder 41, member 40 and through which the hollow interior 35 passes. These gears collectively comprise the main drive connection for the helix drive members. It should be understood as well that the individual gears 102-108 can be operatively supported by bearings or shafts operatively mounted within recesses or over pins molded into the interior surfaces of cover 14 and front wall 19, in positions or at locations that provide a pattern coordinated with and complementary to the pivot axis of gears 102-110, for example axis 105 as shown for gear 104. It should also be understood that the bulge 11 and the recess 13 accommodate the position of gear 108 as well as provide the mounting capability of the gearmotor housing as described herein.

The gears 102-110 can each be one piece molded structures and can be formed from a variety of materials including plastics, thermo-plastics, poly-carbonates, nylon, filled or reinforced plastics, metal, combinations of metal and plastic or of other formable or shapeable materials, including composite materials.

Figure 6A:
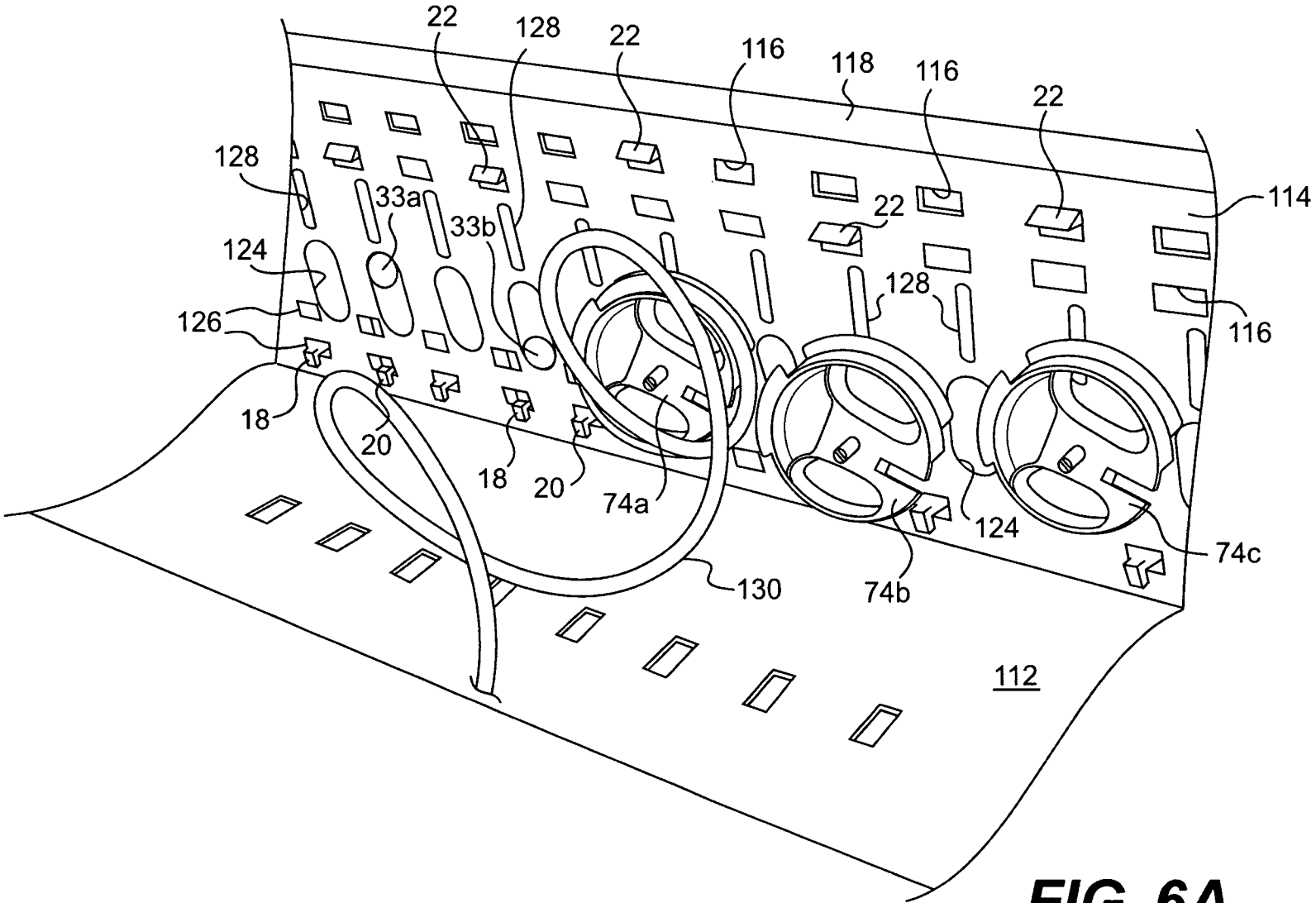
FIG. 6A is a perspective view of a vending tray showing the rear and bottom panels, several helix drive members and one exemplary helix
Figure 6B:
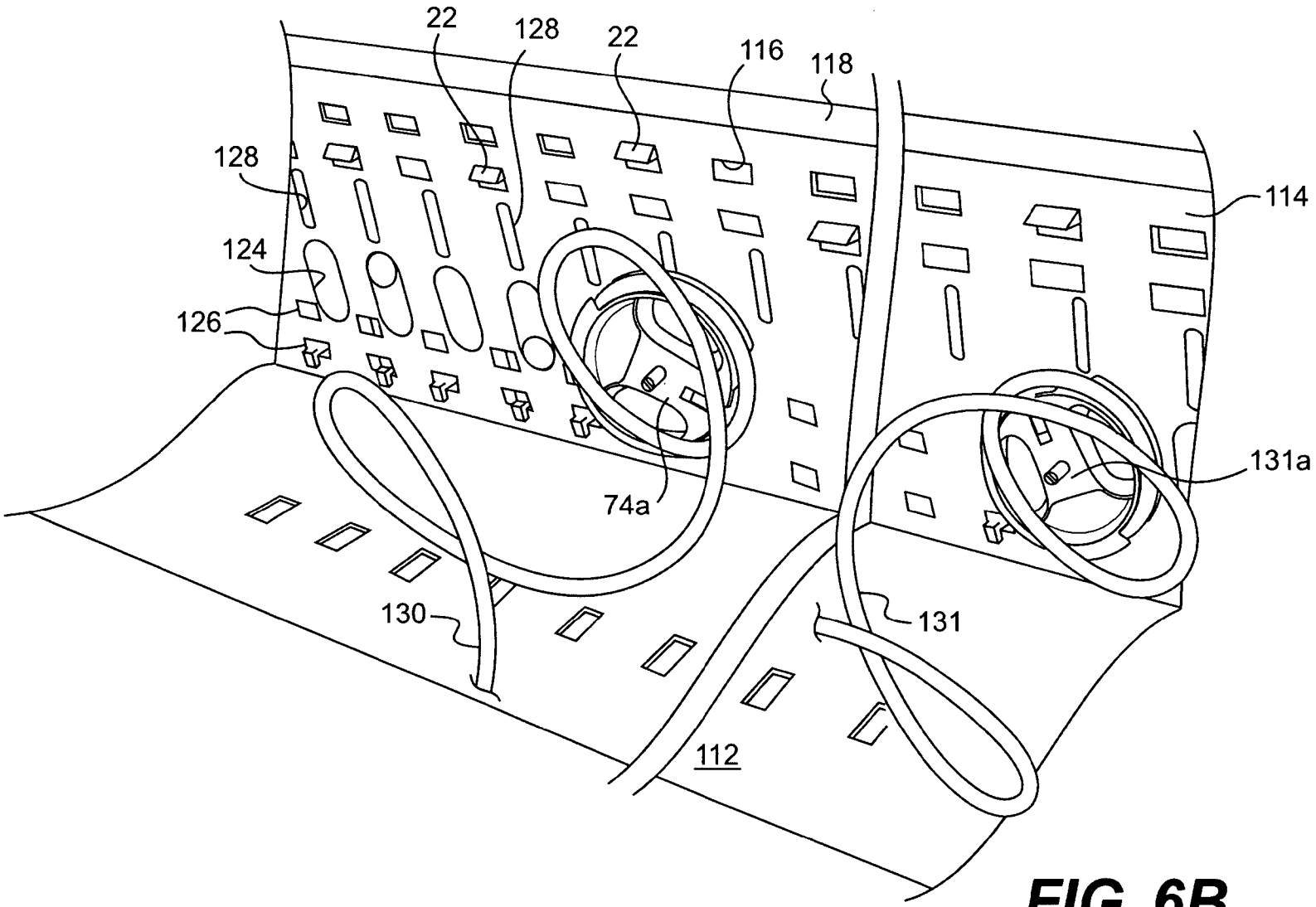
FIG. 6B is a view similar to FIG. 6A, but showing two adjacent helixes that spiral in opposite directions.

FIGS. 6A, 6B, and 7 show portions of a vending shelf or tray and a variety of ways in which gearmotor 10 can be mounted and used thereon. FIG. 6A shows a portion of a tray 110 which will be mounted in a vending machine and which is comprised of a horizontal product support 112, only a portion being shown as the remainder of the tray body includes the rest of the bottom and side walls, as well as a portion of a rear wall 114 that will be attached to the back of the tray body.

Rear wall 114 has been formed with a series of apertures therein, the first being two parallel rows of a plurality of horizontally extending slots 116, that can, for example, extend parallel with a top edge 118 thereof with slots 116 being spaced about 1 inch downwardly from the top edge 118. Next below slots 116 a plurality of spaced apart vertically extending slots 128 can be formed that can be axially aligned with the right side of each slot 116. Beneath vertical slots 128 is a row of a plurality of spaced apart, elongated oval openings 124 that are aligned with vertical slots 128. Beneath the elongated oval openings 124 is another set of apertures in the form of two rows of a plurality of horizontal slots 126 that are spaced an equal distance away from a vertical line that extends through slots 116, vertical slots 128 and oval openings 124. The distance between slots 116 is 1.31 inches, between vertical slots 128 is 1.31 inches, between oval openings 124 is 1.31 inches and between slots 126 is also 1.31 inches. It should be understood that tabs 18 and 20 fit into one half of the horizontal dimension of slots 126 while mounting clip 22 fits into slots 116. Thus, with gearmotors 10 being spaced apart, as shown in FIGS. 6A, 6B and 7, clip 22 will be located horizontally across the rear wall 114 in every other slot 116, for example, and tabs 18/20 for one gearmotor 10 will be located in portions of respectively aligned slots 126. Where gearmotors 10 are positioned directly adjacent one another with the bulge on one being nested within the recess of the adjacent gearmotor, for example as shown in full line and dotted line in FIG. 4, then clips 22 will be in adjacent slots 116 and a tab 18 from one gearmotor 10 will occupy one half of one slot 126 while a tab 20 from the next adjacent gearmotor 10 will occupy the remaining half of that same slot 126.

FIG. 6A shows one helix 130 as being connected to a helix drive member 74*a* which is shown in greater detail in FIG. 2. Helix 130 is one example of a helix and is connected to helix drive member 74*a* that can have a diameter of 2.25 inches. As shown in FIG. 2, helix drive member 74 preferably has an outer end 140 that is integrally molded with the square shaft 76 that can be integrally formed with a central hub 75. Shaft 76 has an outer end comprised of spaced apart fingers 73 each supporting on an outer surface a lug 77 that will provide a spring type fit within hollow interior 35. An outer end 140, which can also be formed as an integral structure extending about hub 75, includes a rear portion in the form of two opposing wings 144 and 146 that are positioned on a rear side of a cylindrical surface 148. Another set of wings 150 and 152 are positioned on the front side of cylinder surface 148. Wing 152 is also provided with two segments 152*a* and 152*b* which are positioned about 90 degrees from wings 144 and 146 and lie on the opposite side of the cylindrical surface 148. Wing 152 can be formed as a continuous structure or, alternatively, with one of more spaces or gaps, for example as is shown at 154, between wing sections 152*a* and 152*b*. A tab or retainer 156 is formed on each of wing segments 152*a* and 152*b* and will serve as a lock for releasably retaining a bent end 159 of a helix 158 a portion of which is shown in phantom in FIG. 2. That helix 158 will also wrap around the cylindrical surface 148 and be held between wings 144, 146 150 and segments 152*a* and 152*b* as is also shown in FIG. 6A.

Helix drive members, like those shown at 70 and 74, are preferably molded as one piece structures and can be formed from a variety of materials including plastics, thermo-plastics, nylon, poly-carbonates, filled or reinforced plastics, metal, combinations of metal and plastic or of other moldable, formable or shapeable materials, including composite materials.

FIG. 6A shows three exemplary helix drives 74*a*, 74*b* and 74*c* with the center one being at a different level than the outer two. It can be noted that the locking tab 22 for the center assembly 74*b* is located in a bottom slot 116 while the two locking tabs 22 for the two outer assemblies 74*a* and 74*c* are located in the upper slots 116. The extension 33 formed on rear cover 14 has an outer diameter that is approximately equal to the width of the elongated oval 124. Consequently, when locking tab 22 is in a lower of the two slots 116 extension member 33 will be positioned at the bottom of oval 124 and conversely when locking tab 22 is in an upper of the two rows of slots 116 extension member 33 will be positioned at the top of oval 124. This moves the axis of shaft 76, for example, about 11/16 inches one way or the other as shown at 33*a* and 33*b* to the left of helix drive 74*a* in FIG. 6A, respectively showing the upper and lower locations where the helix drive shafts can be positioned depending upon the orientation of gearmotor 10 on the tray 110. That change permits a range of helix drive members to be used, including either larger or smaller diameter helix members, through the use of only one drive gearmotor.

FIG. 6B shows a tray similar to that shown in FIG. 6A, but here two helixes 130 and 131 are shown as being driven by gearmotors 10 (not shown) that have been mounted to the rear of rear wall 114 with one set to drive the left most helix 130 in a counter clockwise direction, via helix drive member 74*a*, while the right helix 131 is driven in a clockwise direction by helix drive member 131*a*. The drive gearmotors for helixes 130 and 131 can be an electrically coupled gearmotor pair energized simultaneously by the vending machine control system. In this instance, where two helixes are being used for one product, the spiral direction of helix 130 is also the reverse of that for helix 131. Since the drive direction for each associated drive gearmotor 10 is easy to reverse, one need only install, for example, a pair of spaced apart gearmotors 10 with each being located at a desired location on the rear wall 114 of the tray. Then the helix drives 74*a* and 131*a* would be attached to their respective gearmotor and then a chosen helix, for example 130 and 131, respectively, would be mounted or attached on each of the respective helix drives. Then the rotation direction for each of the paired gearmotors can be established to properly drive each helix in a desired direction of rotation. As shown in FIG. 6B the rear wall 114 and the bottom 112 have been shown with a gap indicating that the spacing between the two helixes 130 and 131 can be variable depending upon the size and shape of the article or product to be held and moved. This way a single wide or large product, for example a submarine sandwich, can be held within two adjacent helixes, such as helixes 130 and 131, and by using the coupled pair of gearmotors 10 the adjacent helixes will be able to be rotated in opposite directions so that they will together move that product along the tray and eventually dispense a product off the front of the tray, into the vending space and then to the product retrieval area. In this example, the left side of such a sandwich can be moved by the left helix 130 that is being driven by its gearmotor 10 to spiral in a counter clockwise direction while the right helix 131 will be rotated by its gearmotor 10 to turn in a clockwise direction. Consequently, gearmotor 10 can be used to drive single helix arrangements, as discussed above, and the same form of gearmotor 10 can be used, for example, in coupled pairs, one for each one of a multiple number of helixes or helix arrangements, for example in dual-spiral selections wherein each of the helixes will be rotated by its own gearmotor 10 in one of a clockwise or counter clockwise direction and thereby work in tandem to move product.

Figures 9A, 9B, 9C:
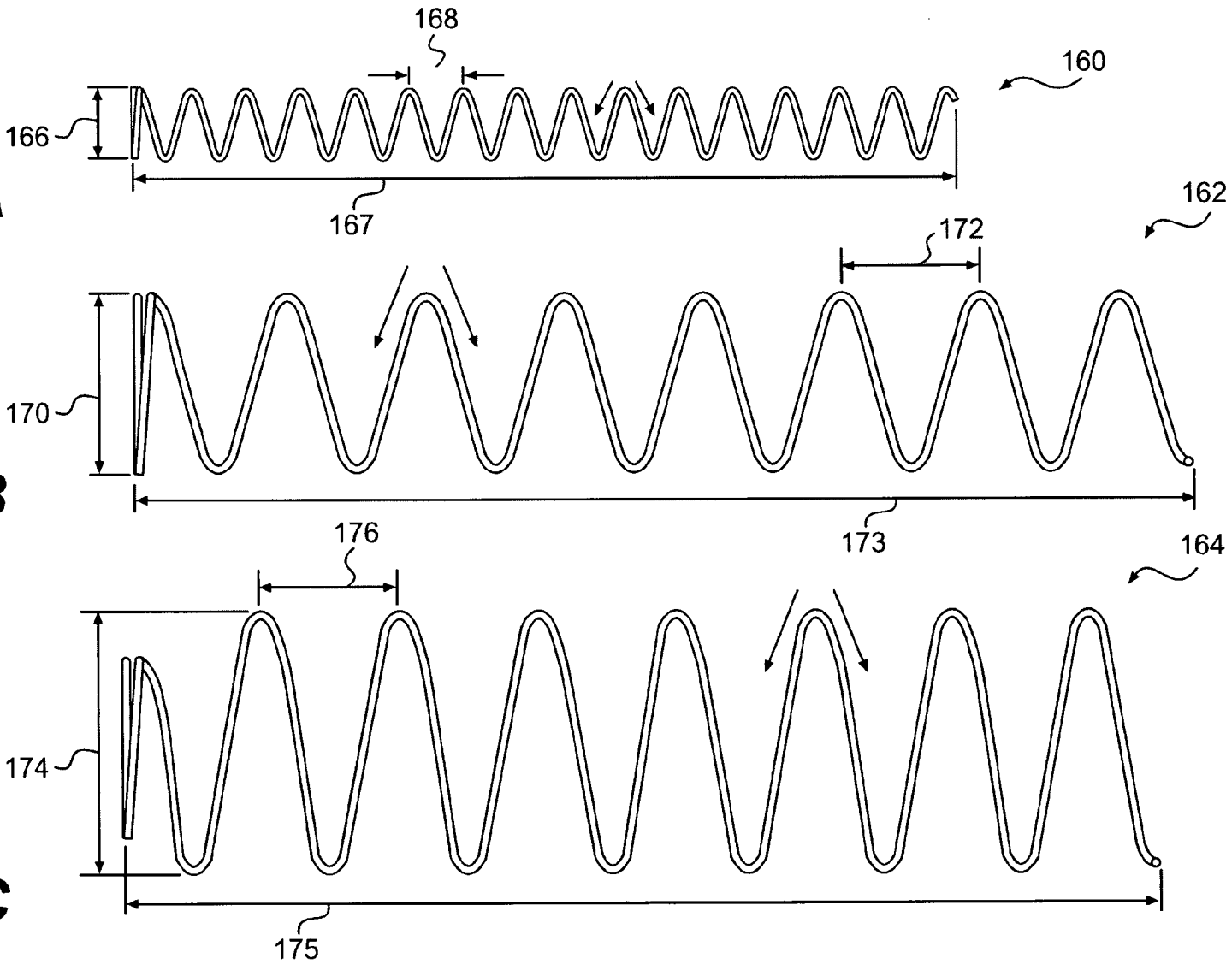
FIGS. 9A-9C show side elevational views of three exemplary helix drives.

FIGS. 9A-9C shows three exemplary helix forms at 160, 162 and 164. Helix 160 has a diameter 166 of about 1.5 inches, a slot width 168 that can range between 9/16 and 1+ inches, with the number of available slots ranging between 15-25 and with an overall length 167 of about 17.8 inches. Helix 162 has a diameter 170 of about 2.6 inches, a slot width 172 that can range between 11/16 and 4.2 inches, with the number of available slots ranging between 5-32 and with an overall length 173 of about 22⅞ inches. Helix 164 has a diameter 174 of about 3.75 inches, a slot width 176 that can range between 0.90 and 4.26 inches, with the number of available slots ranging between 4 and 24 and with an overall length 175 of about 22⅞ inches.

FIG. 1 shows a smaller helix drive member 70 that has a diameter of 1.45 inches and serves to drive smaller helix devices. The construction and connection of drive 70 is preferably like that described above for drive 74 and the integral shaft 72 has the same dimensions as shaft 76 as both fit within drive cylinder 41. It should be understood that helix drive members having sizes different from those discussed herein for helix drive members 70 and 74 can be used with such sizes being larger or smaller depending upon the diameter of a particular helix to be used and the product to be vended.

While is it preferred to simply vary the orientation of gearmotors 10 both vertically and horizontally, it is also possible that gearmotor 10 can be used in an inverted orientation and be used in a manner opposite to that shown in full line in FIG. 7 or in a reverse or flipped condition, as shown at 195 in FIG. 7. When so flipper over the axis of drive cylinder 41 could be positioned at locations other than those shown herein for gearmotors 10.

The rear view of the tray 110 as shown in FIG. 7 shows a wire harness 190 coming from a main power supply for a vending machine with an exemplary vending machine control circuit being set forth in FIG. 8.

With reference to FIG. 7, four individual gearmotors 10 are shown in two different orientations, with one being a higher and two being at lower locations. Each gearmotor 10 has two wires connected thereto coming from harness 190 and with reference to the left most gearmotor 10 and to FIG. 10, wires 192 and 194 are shown as being connected to terminals 50 and 52, respectively. Wire 192 provides a 24 volt connection to terminal 50 and each will be a different colored wire per gearmotor with the color being chosen so as to correspond to a desired column as chosen by a purchaser for vending a selected product. Wire 194 will, on the other hand, be a red/black common wire and will indicate a common row. These same connections are shown in FIG. 8 for each of the rows of gearmotors "0-9" in that figure.

FIG. 8 shows a control board 200 at the left from which a number of onboard items extend and by which they are controlled. Included within the vending machine features, are lights 202 connected via a lamp relay 204. A vending machine can include a number of trays for storing product and from which selected products will be vended. FIG. 8 shows three exemplary trays 206, 208 and 210, with each tray having ten individual gearmotors depicted by numerals "0-9," respectively. Wires 192 are shown leading into gearmotors 10 from the top and these will be the colored wires mentioned above as being used to determine a particular column of goods. The wires 194 are shown below gearmotors 10 and will provide the ability for determining a chosen row of gearmotors 10.

Also shown is a display 220 for providing information to a user concerning a vend, a key pad 222 by which a user may enter information to the control system 200 and a product delivery sensing system 224 for sensing products falling through a vend space provided between the inside of a glass front door, the front edges of the product trays and extending across a substantial width of the area in front of the product trays. In this regard attention is directed to U.S. Pat. Nos. 6,384,402; 6,794,634; 7,191,915; 7,343,220; and 7,742,837, each of which is fully incorporated herein by reference thereto.

D. Operation

The design of the gearmotor described herein above permits one single type of gearmotor to be used throughout a vending machine. This eliminates the necessity of having to provide several different types and sizes of gearmotors to operate various size helix drives regardless of the product being dispensed.

In setting up a particular vending machine one would first determine what products were to be offered for purchase and then how those products would be stored for display through a glass front vending machine, on which product trays they would be retained and what size helix drives would be needed for each tray.

With the above decisions made each tray can then be fitted with gearmotors 10 in a manner that fits the spacing between the helix drives, their sizes and what size helix drive member 70, 74 or another size to fit the helix chosen. Then, gearmotors 10 can be secured into the rear wall 114 of each product tray 110 and positioned using slots 116 and 126 to mount gearmotors 10 where required for the helix and helix drive member chosen for that tray at that location. In addition, since helixes may need to be driven in either a clockwise or counter clockwise direction, a decision can be made when mounting gearmotors 10 in which direction the motor should be set and then wires 36/38 can be properly connected to produce the desired rotation when the gearmotor 10 is actuated.

Then an appropriate wiring harness will be connected to the individual gearmotors 10 installed on each tray thereby connecting each gearmotor 10 to the control system 200 for that vending machine. Consequently, when a purchaser has selected a particular product the control system 200 will then identify a specific row and column location for the selected product and the gearmotor 10 at that location will be actuated and will then rotate the helix for the selected product and upon rotation of that selected gearmotor and helix combination a product will be dispensed to the purchaser. As explained above, the home position of a helix will be established by cylindrical drive member 40 operating in conjunction with micro switch 86 and the home position circuit which is part of control system 200 senses when the flat portion 42 of member 40 has again released button 94 so that the control system 200 can then turn off the selected gearmotor 10.

From the foregoing, it should be clear that should marketing or other considerations dictate it can be seen that a variety of helix combinations and rotation direction changes are provided for with this apparatus, that the gearmotor as described herein can have a variety of orientations within a vending machine and on a product vending tray, that the gearmotor configuration makes it a greatly simplified matter to alter the rotation direction of the motor thus permitting the rotation direction to be reversed at any time by simply transposing the positions of wires 54 and 56 as opposed to the necessity of replacing a complete gearmotor assembly with one configured to rotate in an opposite direction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi purpose vending machine gearmotor comprising:

an outer housing with opposing side and end walls with one side wall having a bulge and an opposite side wall having a recess complementary to the bulge, with the bulge being likewise complementary to the recess a front wall and a rear wall, said outer housing including mounting devices at each of two opposing ends;

an electric drive motor mounted onto said outer housing and having a drive shaft extending into said outer housing;

a drive member rotatably mounted within said outer housing and being accessible from at least one of the front and rear walls;

a gear train operatively mounted interiorly of said outer housing and interconnecting the drive shaft and the drive member;

a set of motor connections including a first sub-set for controlling the rotation direction of the motor and a second sub-set for providing power to the motor;

wherein the first sub-set of motor connections permits the gearmotor to be operated in either clockwise or counterclockwise rotational directions by switching the connection points;

a helix drive member having a shaft that will removably engage the drive member and a helix connector portion removably attachable to one end of a helix used for feeding product in a vending machine; and wherein the helix drive member comprises a central hub, a drive shaft integral with the central hub, a cylindrical outer surface, a set of spaced apart structures extending outwardly from at least portions of the cylindrical outer surface and on opposite sides thereof so as to encompass opposite sides of an end most spiral of one helix member, and further including a retainer on one of the structures to removably secure the helix member to the helix drive member.

2. The gearmotor as in claim 1 further including an outer housing having a shape permitting nesting with adjacent gearmotors.

3. The gearmotor as in claim 1 wherein the helix drive member comprises a one piece molded structure including both the shaft and the helix connector portion.

4. The gearmotor as in claim 1 wherein the bulge and recessed side walls are nestable with another like gearmotor on either side.

5. The gearmotor as in claim 1 further including a control circuit for controlling the operation of the gearmotor and further including a home position indicator for the drive member thereby permitting a particular position of rotation to be sensed.

6. The gearmotor as in claim 5 wherein the home position indicator includes a flattened portion formed on the drive member that will engage with a micro switch to indicate a home position.

7. The gearmotor as in claim 1 wherein the helix drive member is comprised of a hub, the drive shaft being fixed to the hub and interfitting within the drive member, and wherein the helix connector portion is located outwardly of the hub and includes spaced helix retainer members that will engage and retain an end of a helix.

8. The gearmotor as in claim 7 wherein the helix drive member is an integrally molded one piece structure.

9. The gearmotor and product storage tray as claimed in claim 1 wherein the gearmotor can be mounted in a first vertical orientation and alternatively in a second inverted orientation.

10. A gearmotor and product storage tray combination for vending a variety of products therefrom comprising:

a storage tray including a rear wall having front and rear sides and at least a forwardly extending bottom wall;

the rear wall including an array of individual, spaced apart apertures in the form of a first set of two rows of spaced apart, horizontally extending apertures positioned adjacent and spaced below a top edge thereof, a second set of two rows of individual, spaced apart apertures positioned adjacent and spaced above a bottom edge, and a row of individual, spaced apart apertures positioned to extend vertically and intermediate an innermost set of apertures of each of the first and second sets of two rows of spaced apart apertures;

a plurality of gearmotors having shaped sidewalls with one side wall containing a bulge and an opposite side wall containing a recess at a location to receive a bulge from an adjacent gearmotor with the bulges and recesses being complimentary, each gearmotor being adapted to be mounted on the rear side of the rear wall in one of a plurality of orientations and within at least one aperture in the top two rows and within at least one aperture within the bottom two rows and having a drive member positioned so as to be aligned with one aperture within the intermediate row of apertures;

each gearmotor having mounting members at each of two opposing ends, said mounting members being sized to occupy half of a horizontal dimension of the apertures in the first and second sets, a plurality of helixes with the size of each helix being coordinated with a vertical positioning of each gearmotor on the rear wall, and a helix drive member operatively connected with each at least one gearmotor on the front side of the rear wall.

11. The gearmotor and product storage tray as claimed in claim 10 wherein the helix drive member comprises a central hub, a drive shaft integral with the central hub and extending outwardly there from in a direction normal thereto, and a shaped helix interconnection structure integral with the central hub and comprising a plurality of circumferentially extending, axially offset members extending outwardly in a substantially planar fashion there from to engage portions of opposite sides of an end spiral of a helix and at least one retainer for removably holding an end of the helix in place.

12. The gearmotor and product storage tray as claimed in claim 10 wherein the individual apertures forming the top two rows are vertically aligned with at least a portion of the individual apertures in the bottom two rows.

13. The gearmotor and product storage tray as claimed in claim 10 wherein the gearmotors are mounted directly adjacent one another in a nested manner with the bulge of one gearmotor positioned within a recess of an adjacent gearmotor.

14. The gearmotor and product storage tray as claimed in 10 wherein two identical gearmotors are positioned in a spaced apart manner to each drive a respective one of two spaced apart helixes for holding and moving a product in a coordinated manner, with each helix having opposite spiral directions and wherein one gearmotor is set to rotate one helix in a counter clockwise direction and the other of the two gearmotors is set to rotate the other helix in a clockwise direction.

15. The gearmotor and product storage tray as claimed in claim 10 wherein the helix drive member comprises a central hub, a drive shaft integral with the central hub, a cylindrical outer surface, a set of spaced apart structures extending outwardly from at least portions of the cylindrical outer surface and on opposite sides thereof so as to encompass opposite sides of an end most spiral of one helix member, and further including a retainer on one of the structures to removably secure the helix member to the helix drive member.

16. The gearmotor and product storage tray as claimed in claim 10 wherein the gearmotor can be mounted in a first vertical orientation and alternatively in a second inverted orientation.

* * * * *